US008440922B2

(12) United States Patent
Yeates et al.

(10) Patent No.: US 8,440,922 B2
(45) Date of Patent: May 14, 2013

(54) WATER INHIBITING SLIDE SWITCH

(75) Inventors: Kyle Yeates, Palo Alto, CA (US); Teodor Dabov, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 300 days.

(21) Appl. No.: 12/970,759

(22) Filed: Dec. 16, 2010

(65) Prior Publication Data

US 2012/0055767 A1 Mar. 8, 2012

Related U.S. Application Data

(60) Provisional application No. 61/381,034, filed on Sep. 8, 2010.

(51) Int. Cl.
*H01H 13/00* (2006.01)

(52) U.S. Cl.
USPC ..... 200/16 R

(58) Field of Classification Search ..... 200/16 R, 200/1 R, 61.04, 61.06, 302.1; 340/603
See application file for complete search history.

(56) References Cited

U.S. PATENT DOCUMENTS

| | | | | |
|---|---|---|---|---|
| 2,785,240 | A * | 3/1957 | Carling | 200/16 D |
| 3,983,527 | A * | 9/1976 | Ohsato et al. | 338/35 |
| 6,630,636 | B2 * | 10/2003 | Nakamura | 200/16 R |
| 2007/0075046 | A1 | 4/2007 | Nakamura et al. | |
| 2009/0095609 | A1 | 4/2009 | Ruff | |
| 2010/0062663 | A1 | 3/2010 | Kobayashi | |
| 2011/0050431 | A1 * | 3/2011 | Hood et al. | 340/603 |

* cited by examiner

*Primary Examiner* — Edwin A. Leon
(74) *Attorney, Agent, or Firm* — Womble Carlyle Sandridge & Rice LLP

(57) ABSTRACT

Electromechanical switches are provided. The electromechanical switches can include conductive components that are configured to change position relative to one another in response to a mechanical input. The electromechanical switch can include a distribution mechanism for replenishing a moisture inhibiting layer, such as an oleophobic material, on surface portions of conductive components within the switch. During actuation of the electromechanical switch, the distribution mechanism can be configured to reapply the moisture inhibiting material to the surface portions of the conductive components to prevent damage resulting from moisture intrusion.

23 Claims, 13 Drawing Sheets

WATER INHIBITING SLIDE SWITCH

CROSS REFERENCE TO RELATED APPLICATIONS

This application claims priority under 35 U.S.C. §119(e) from co-pending U.S. Provisional Patent Application No. 61/381,034, filed Sep. 8, 2010, titled "WATER INHIBITING SLIDE SWITCH," which is incorporated by reference and for all purposes.

BACKGROUND OF THE INVENTION

1. Field of the Invention

The described embodiments relate generally to portable computing devices. More particularly, the present embodiments relate to providing protection against moisture intrusion.

2. Description of the Related Art

In recent years, small form factor consumer electronic products such as media players and cellular phones have become smaller, lighter and yet more capable by incorporating more powerful operating components into smaller and more densely packed configurations. This reduction in size and increase in density can be attributed in part to the manufacturer's ability to fabricate various operational components such as processors and memory devices in ever smaller sizes while increasing their power and/or operating speed. However, this trend to smaller sizes and increase in component density and power, however, poses a number of continuing design and assembly challenges.

For example, small form factor consumer electronic products, such as a media player, can require the assembly of a number of components into an enclosure having an extremely small volume. Assembling the various components into the housing having such a small size can require complex, expensive, and time consuming assembly techniques. Moreover, aesthetic considerations can severely restrict the placement, size, and number of components used in the manufacture of the small form factor consumer electronic product. For example, proper alignment of external features such as buttons can be extremely difficult to accomplish when the small size of the consumer electronic device itself can severely reduce the available tolerance stack of the assembled components.

Yet another design challenge is insuring that the assembled components that are visible maintain their aesthetic look and "feel" over an expected operating lifetime and under anticipated environment operating conditions of the consumer electronic product. One component that can be visible on a consumer electronic product is a switch. Typically, a switch, such as an electromechanical switch, can be user actuated to provide operational inputs for controlling a device. For electromechanical switches, it is desirable that, over the expected lifetime of the device, 1) the switch maintains operable for its intended purpose, i.e., a proper input is generated according to the switch position, and 2) the "feel" of the switch is maintained, i.e., it moves smoothly from position to position in the manner for which it was designed and does not stick.

An environmental condition that can cause an electromechanical switch to deviate from its intended operational performance is moisture intrusion. Moisture intrusion can facilitate the build-up of oxides on metal components or the deposition of particulates within the switch that can affect the switch's electrical outputs and the feel of the switch during actuation. For small, high-density components with limited operational tolerances, preventing moisture intrusion can be difficult. Thus, in view of the foregoing, there is a need for improved techniques for inhibiting moisture flow and/or mitigating the effects of moisture intrusion in consumer electronic products.

SUMMARY OF THE DESCRIBED EMBODIMENTS

Broadly speaking, the embodiments disclosed herein describe methods, apparatus and materials for forming components well suited for use in consumer electronic devices, such as laptops, cellphones, netbook computers, portable media players and tablet computers. In more detail, the embodiments relate to systems, methods, and apparatus for providing a moisture resistant environment for small form factor electronic devices. In a particular, the systems, methods and apparatus can be related to providing a moisture resistant environment that can be applied to the design of electromechanical switches. The electromechanical switches, described herein, can typically be located on an outer surface of the consumer electronic device and can be configured to provide an electrical output signal in response to an actuation of the switch via an applied mechanical force, such as in response to a mechanical force generated by a user.

For the electromechanical switch, a two pronged approach can be used to provide a moisture resistant environment. First, the switch can be sealed to limit moisture intrusion. Second, features can be included within the switch that help to mitigate the effects of any moisture that penetrates into the switch. Towards mitigating moisture effects, a distribution mechanism for a moisture inhibiting material, such as an oleophobic material, can be included within the electromechanical switch. In one embodiment, the distribution mechanism can be configured to continually reapply the moisture inhibiting material on sensitive components during operation of the switch.

An electromechanical switch can include conductive components, such as metal components, that allow circuits with differing electrical properties to be formed depending on a position of the electromechanical switch. Moisture intrusion within the switch can degrade switch performance over time as a result of water-based electrochemical deposition processes that can occur when conductive components are exposed to water. The water-based electrochemical deposition process can be mitigated by providing a moisture inhibiting coating on the conductive components, such as a coating of an oleophobic material. Friction between components within the electromechanical switch during repeated actuation of the switch can remove the moisture inhibiting material. The distribution mechanism for the moisture inhibiting material can be configured to reapply the moisture inhibiting material to one or more conductive surfaces within the switch so that during operation a moisture barrier is maintained and/or replenished on the one or more conductive surfaces where the moisture inhibiting material might be removed as a result of friction. Thus, a degradation of switch performance during its operational lifetime can be prevented.

In one embodiment, an electromechanical switch is provided. The electromechanical switch can include conductive components that are configured to change position relative to one another in response to a mechanical input where a change in position of the conductive components relative to one another affects electrical properties of a circuit including the conductive components. The electromechanical switch can further include a distribution mechanism for replenishing on surfaces within the switch a moisture inhibiting layer formed from a material, such as an oleophobic material. In particular, when the moisture inhibiting material is removed from the different surface portions as a result of at least friction between the conductive components during actuation of the electromechanical switch, the distribution mechanism can be configured to replenish the moisture inhibiting material in areas where it has been removed.

In a particular embodiment, a slider switch with a distribution mechanism for applying a moisture inhibiting material can be provided. The slider switch can include 1) a carrier body including an electrical bridging component attached to the carrier body and 2) a base including a number of electrical contact pads. When the base is mounted to a housing of an electronic device, the base and the carrier body can be configured to change positions relative one another, such as when a sliding force is applied to the carrier body.

In one embodiment, the electrical bridging component can be a conductive spring arm, such as a metal spring arm and the base can include three or more electrical contact pads, such as metal contact pads. The sliding force can cause the spring arm to make electrical contact with no more than two of the electrical contact pads at a time. Thus, in different positions of the electromechanical switch, the spring arm can be in contact with different ones of the electrical contact pads. When the carrier body moves relative to the base of the slide switch, the moisture inhibiting distribution mechanism can be configured to reapply a moisture inhibiting layer to portions of a surface of each of the contact pads. In particular, to prevent moisture intrusion and resulting electrochemical processes that can damage the switch, the moisture inhibiting layer can be replenished over portions of contact pads that are not in contact with the spring arm thereby providing a moisture barrier at all times.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF SELECTED EMBODIMENTS

Figure 1:
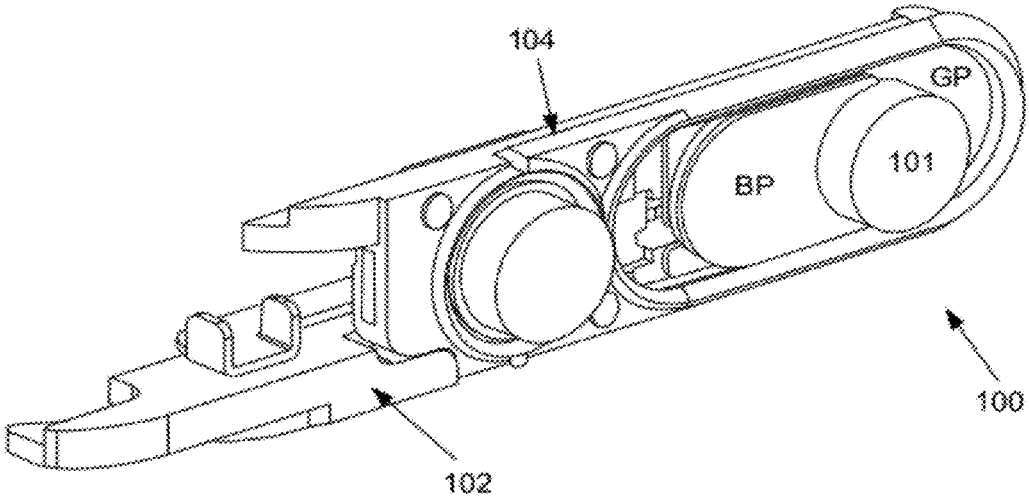
FIG. 1 is a perspective drawing of a slide switch assembly in accordance with the described embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Apparatus, methods and systems are described for improving moisture resistance in electronic devices. Electrochemical processes associated with moisture intrusion can damage and thus, reduce the operational lifetime of electronic devices and otherwise prevent the electronic device from operating in accordance to its intended design. When moisture instruction occurs, water-based electrochemical processes can cause corrosion of metal components and a deposition of materials that can cause shorts in electronic circuitry. An electrochemical switch is one example of component included on an electronic device that can be susceptible to damage from moisture intrusion and its associated water-based electrochemical processes.

In more detail, an electromechanical switch can include conductive contact pads and a conductive bridging component for forming an electrical circuit involving two or more of the conductive contact pads. The electromechanical switch can be configured so that a position of the bridging component and the conductive pads are adjustable relative to one another. A positional change involving the components of the switch can proceed in response to application of mechanical force to the switch. By changing the position of the conductive component relative to the conductive pads, the conductive component can be brought into contact with different ones of the conductive pads to change the electrical properties associated with the switch. The electrical properties of the switch in different positions can be detected and can be used to determine a control signal related to operation of the electronic device including the switch.

As a result of repeated actuation of the switch, i.e., when the position of the bridging component and the conductive pads are changed relative to one another, the friction resulting from the bridging component and the conductive pads moving against one another can cause a loss of material from one or both of the conductive pads and the bridging component. As an example, for a bridging component with a contact surface that is narrower than the conductive pad, a rut about the width of the contact surface can form in the conductive pad as a result of repeated actuation of the switch. The depth of the rut can increase over time as more material is lost from the contact pad.

To prevent damage resulting from moisture intrusion into a component, such as a switch, a moisture barrier including seals can be provided that is intended to limit the moisture penetration into the component. The ability of the moisture barrier to prevent moisture penetration is related to the quality of the seals. For a component, such as an electronic switch with parts that move relative to one another, maintaining a moisture-proof seal while allowing the components to move easily relative to one another can be difficult.

In light of the difficultly of providing a moisture proof seal for a moveable component, measures can be taken to mitigate the effects of moisture intrusion. One approach mitigating the effects of moisture intrusion is to provide a moisture-inhibiting coating or barrier on the internal components, such as the bridging component and/or conductive pads used to form an electrical circuit in an electromechanical switch. As an example, during assembly, the bridging component and/or conductive pads can be coated with a viscous oleophobic material that is applied in a semi-solid form, such as a "grease." The oleophobic material can prevent moisture from coming into contact with the interior components, such as the bridging component and the conductive pads, and thus, prevent damage on the surface of these components resulting from water-based electrochemical processes.

A difficulty with using a moisture inhibiting coating is that in areas where the bridging component and the contact pads come into contact, the moisture inhibiting coating can be removed as a result of friction. As described above, for a slider switch, friction can cause ruts to be formed in the contact pads where the bridging component and the contact pads slide against one another. In the ruts, where contact is needed to complete an electrical circuit, the moisture inhibiting material can be removed. After the moisture inhibiting coating is removed, water-based electrochemical processes can cause damage that degrades the performance of the switch. The damage can affect the aesthetic feel of the switch, such as by causing the switch to stick, and can possibly prevent the switch from generating proper output signals that are used to control the electronic device.

In the embodiments discussed herein, apparatus and methods are described that allow a moisture inhibiting coating to be maintained on internal surfaces of an electromechanical switch. In one embodiment, a distribution mechanism is described that allows a moisture inhibiting material that is removed as the result of friction between a bridging component and a contact pad to be reapplied to replenish the moisture inhibiting material on these surfaces. The distribution mechanism can be configured to reapply the moisture inhibiting material when the electromechanical switch is actuated as a result of a mechanical input. In one embodiment, the electromechanical switch can be a slider switch where the distribution mechanism reapplies the moisture inhibiting material when the slider switch is moved from position to position.

To illustrate the embodiments, the general operation of an electromechanical switch, such as a slider switch, is described with respect to FIG. 1. With respect to FIG. 2, a slider switch including an applicator for replenishing a moisture inhibiting material is described. In particular, the applicator is coupled to a carrier body associated with the slider switch. A slider switch including a reservoir for the moisture inhibiting material is discussed with respect to FIG. 3. With respect to FIG. 4, an embodiment where an applicator for the moisture inhibiting material is coupled to a conductive portion of the switch is described. The actuation of an electromechanical switch, such as a slider switch, including replenishing of the moisture inhibiting material is discussed with respect to FIGS. 5A-B and 6. With respect to FIGS. 7A and 7B, a slider switch including lowered or raised contact pads is discussed. With respect to FIG. 8, a slider switch including contact pads with micro-pits for storing a moisture inhibiting material are described. Finally, an electronic device with the electromechanical switches described herein are discussed with respect to FIGS. 9A-9C.

FIG. 1 shows slide switch assembly 100 in accordance with the described embodiments in more detail. Slide switch assembly 100 can include multiple position slide switch button 101. The position of the slide switch button 101 can be adjusted to provide different signals used to control the operation of an electronic device. An electronic device 400 including a slide switch is described in more detail with respect to FIGS. 9A-C.

Button 101 can take many forms such as a two, three or more position button. For example, when configured as a two position switch, hold switch button 101 can have a first and second position. In order to provide the user with a quick and unambiguous indication of the position of hold switch button 101, colored labels can be used to provide distinctive visual indicia. For instance, the labels can include a green portion (GP on FIG. 1) and a blue portion (BP on FIG. 1) to indicate the position of hold switch button 101.

Slide switch 101 can be configured to slide within switch carrier 102. Slide switch carrier 102 can be formed of any suitable resilient material such as plastic. The slide switch and the switch carrier can be formed from a suitable manufacturing method, such as an injection molding process.

In order to minimize the intrusion of moisture from the external environment through slide switch carrier 102, slide switch carrier seal 104 can be placed on slide switch carrier 102. Slide switch carrier seal 104 can be formed of moisture inhibiting material such as silicone rubber. In this way slide switch carrier seal 104 can have a shape that fits snuggly within slide switch carrier 102. The carrier seal 104 can limit but may not totally prevent moisture intrusion into the internal body of the switch assembly 100.

Internally, the slide switch assembly 100 can include a number of conductive components. The conductive components can form electronic circuits with different electrical properties depending on a position of the slide switch 101. The conductive components can be damaged as a result of moisture that penetrates past the carrier seal 104 and into the internal body of the switch assembly 100. Damage from the moisture intrusion can be prevented by coating the internal conductive components with a moisture inhibiting material, such as an oleophobic material. However, as described above, when the switch assembly 100 is repeatedly actuated, the moisture inhibiting material coating can be removed on portions of the conductive components that come into contact with one another as a result of friction between the components that occurs during actuation of the switch. In the areas where the coating has been removed, chemical processes associated with moisture intrusion can damage the conductive components and affect the operation of the switch 100. Apparatus and methods for preventing this damage are described in more detail with respect to FIGS. 2-8 as follows.

The slide switch assembly 100 is provided for the purposes of illustration only. In other embodiments, different types of slide switches with configurations different that what is shown in FIG. 1 can be utilized. Further, other types of switches with different mechanical actions can be utilized. For instance, a push-button type switch can include a moisture inhibiting material distribution mechanism where the moisture inhibiting material can be spread within the switch as a result of a push actuation of the switch. Further other components used in an electronic device affected by moisture intrusion can be configured with moisture inhibiting material distribution mechanisms, such as the distribution mechanisms described with respect to FIGS. 2-8.

Figure 2:
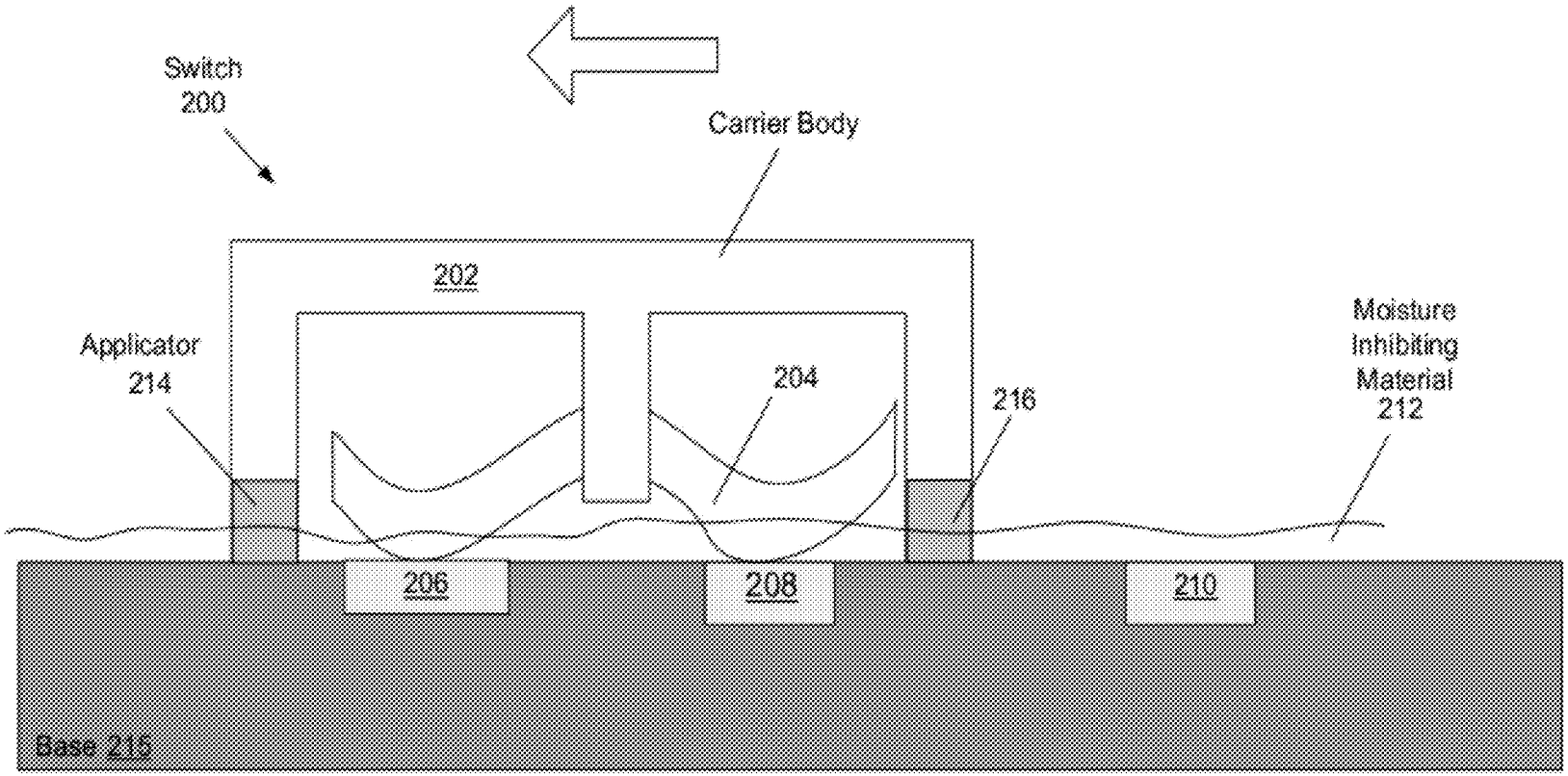
FIG. 2 is a cross sectional view of a slide switch assembly including a moisture-inhibiting material distribution mechanism in accordance with the described embodiments.

FIG. 2 shows cross sectional view 200 of slide switch assembly 200 in accordance with the described embodiments. Slide switch assembly 200 can include carrier body 202 connected to bridging component 204 for making an electrical connection any two of contact pads 206, 208, and 210 at a time. If the switch assembly allowed for more positions, then additional contact pads can be employed. In one embodiment, the bridging component 204 can be a spring arm. The spring arm can be formed from a conductive material, such as a metal.

During actuation of the switch, the carrier body 202 can shifted from a first position to a second position in response to an input force. For instance, the carrier body can be shifted to the left from the right where the carrier body 202 can move in such a way that bridging component 204 can establish an electrical connection between contact pad 206 and contact pad 208. The electrical connection can determine the control signal generated by the switch 200.

After the carrier body 202 is moved to the position shown in FIG. 2, the contact pad 210 can be left bare. Also, as a result of the bridging component 204 moving over the contact pad 210, a surface portion of the contact pad 210 can be removed. The surface portion can include the moisture inhibiting material 212 coating the contact pad as well as an underlying conductive material, such as a metal, used to form the contact pad 210.

When the carrier body 202 is moved in the opposite direction to a position where the bridging component 204 makes contact with contact pads 208 and 210, the contact pad 206 can be left bare. As a result of the bridging component 204 moving over the contact pad 206, a surface portion of the contact pad 206 can be removed. Again, the surface portion can include the moisture inhibiting material 212 coating the contact pad 206 as well as portion of the underlying conductive material used to form the contact pad 206.

In order to prevent corrosion due to the presence of moisture on a bare surface of contact pads 206 or 210, the moisture inhibiting layer 212 can be provided on top of the contact pads 206 and 210 such that it forms a moisture barrier. As described above with respect to FIG. 1, the switch 200 can include one or more seals to prevent moisture intrusion. However, the one or more seals may still allow some moisture to penetrate into the switch.

In particular embodiments, when the carrier body 202 and the base 215 are moved relative to one another, the moisture inhibiting layer can serve to lubricate the switch 200 and reduce friction between the bridging component 204 and the base 215, which includes the contact pads, such as 206, 208 and 210. The reduced friction can affect the aesthetic feel of the switch 200. The moisture inhibiting layer 212 can be formed of oleophobic material such as grease that can inhibit the intrusion of moisture from the external environment from reaching the surface of exposed contact pad 210. Thus, water-based based electrochemical processes, such as corrosion or deposition can be prevented from occurring on the exposed surfaces of the contact pads. As described above, these processes can damage the switch such that its electrical or mechanical properties are affected. For instance, the electrochemical processes can cause electrical shorts in the switch or can cause the switch to stick.

To assure a relatively even distribution of layer 212 over the contact pads, such as 206 and 210, applicators, such as 214 and 216 can be provided. In one embodiment, the applicators can take the form of wipers. In this embodiment, the applicators can be configured to "wipe" the material of layer 212 evenly across the contact pads. Thus, as the carrier body 202 is moved from position to position, friction between the bridging component 204 and the contact pads can cause material, such as the moisture inhibiting material 212 to be removed from the contact pads and the passing of the applicators over the contact pads can cause the moisture inhibiting material 212 to be replenished on the contact pads. In this way, the moisture inhibiting layer 212 can be maintained such that the surfaces of contact pads 206, 208, and 210 can be protected from moisture intrusion and any associated water-based processes that can damage the switch 200.

Figure 3A:
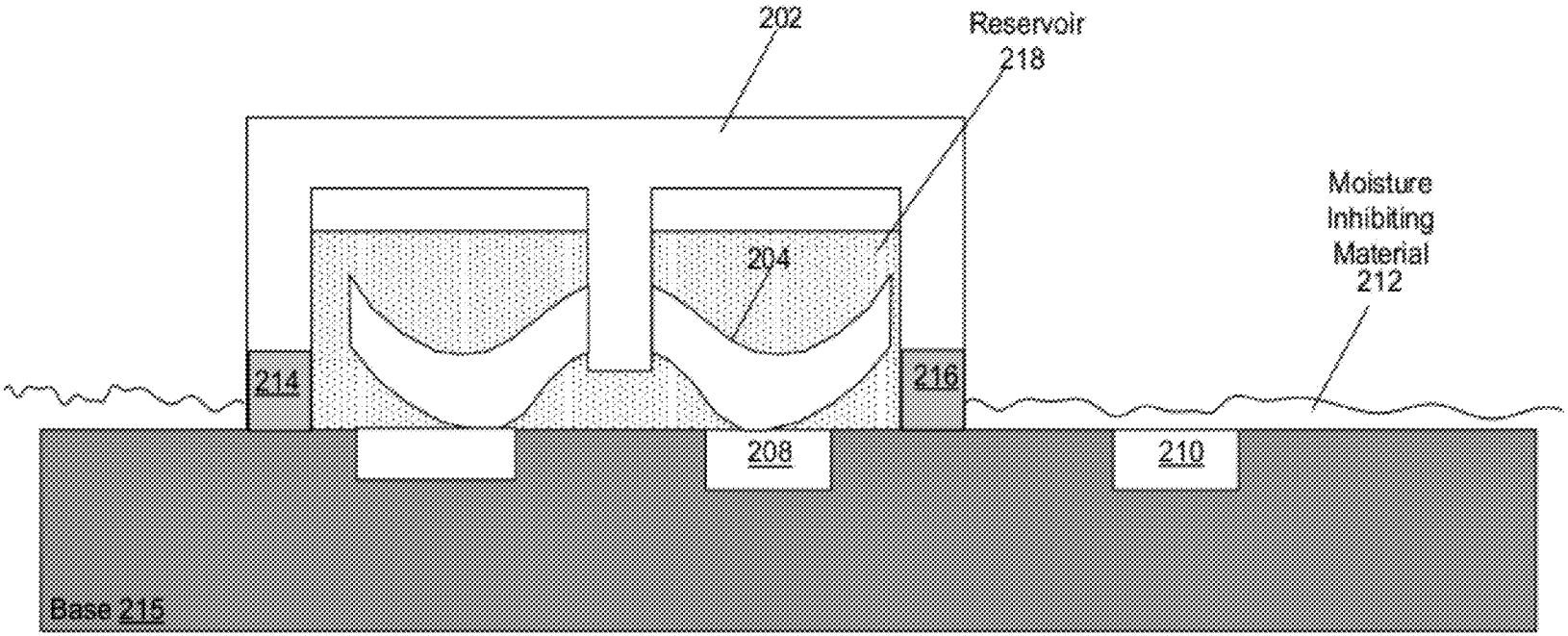
FIGS. 3A and 3B are cross sectional views of a slide switch assembly including a moisture-inhibiting material distribution mechanism and moisture-inhibiting material reservoir in accordance with the described embodiments.

FIG. 3A shows another embodiment whereby applicators 214 and 216 can take the form of foam or silicon. As such, the tips of the applicators 214 and 216 can effectively seal interior 216 of carrier body 202. To seal the interior and form the reservoir 218, an outer perimeter of the carrier body 202 in contact with the base 215 (e.g., see FIG. 5B) can be lined with a sealing material, such as the material used to form the applicators 214 and 216. In this way, a reservoir 218 of lubricant can be formed and maintained and the moisture inhibiting layer 212 can be continuously replenished on the contact pads whenever carrier body 202 is moved from position to position during actuation of the switch. The reservoir 218 can be filled with the moisture inhibiting material 212 during manufacture of the switch.

Figure 3B:
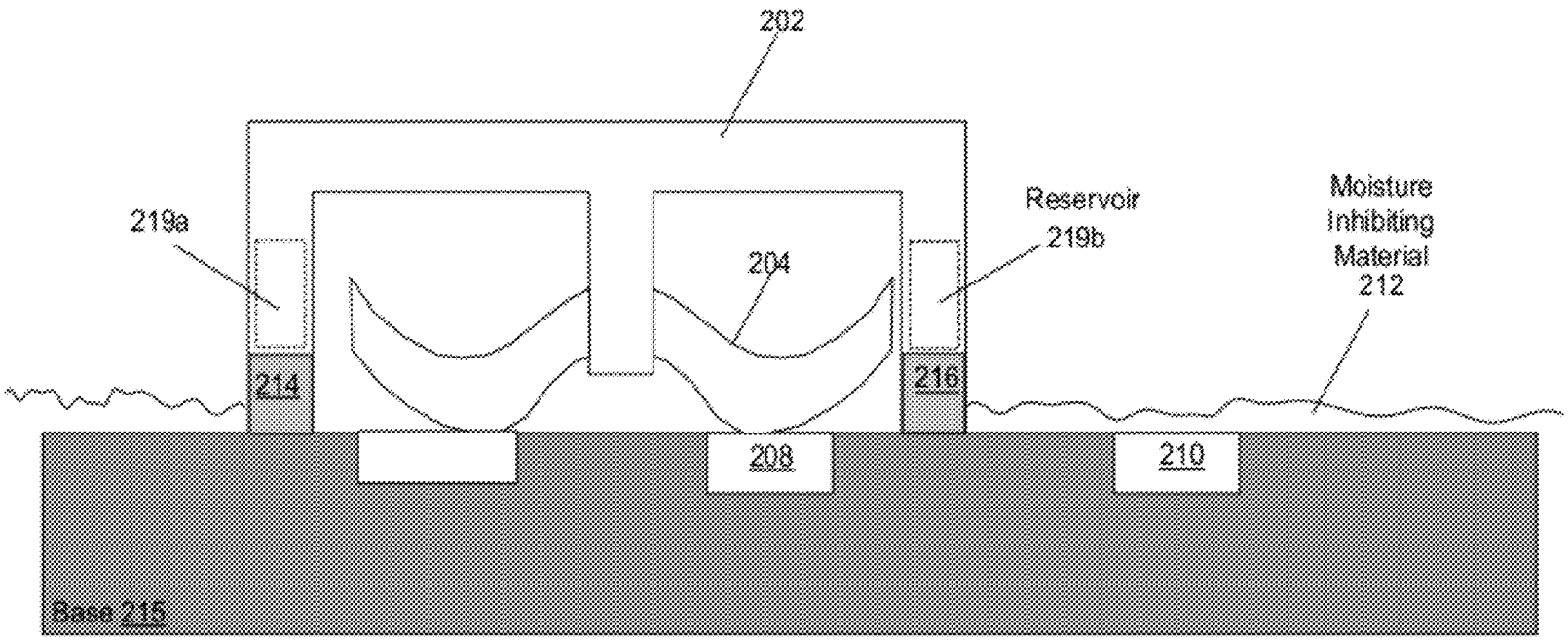

In FIG. 3B an embodiment is described where the applicators 214 and 216 are formed from an absorbant material that can absorb the moisture inhibiting material 212. In one embodiment, the applicators, 214 and 216, can be pre-impregnated with the moisture inhibiting material 212. During actuation of the switch, the applicators can be configured to absorb excess moisture inhibiting material that may have been pushed off the contact pads. The reabsorbed material as well as the material impregnated in the applicators can serve to replenish the moisture inhibiting material on the contact pads during the lifetime of the switch.

In one embodiment, reservoirs, such as 219*a* and 219*b*, can be located in the interior of the carrier body 202. During manufacture, the reservoirs can be filled with the moisture inhibiting material 212. The reservoirs can be coupled to each of the applicators 214 and 216 and can serve to replenish the applicators with moisture inhibiting material during operation of the switch.

An advantage of replenishing the moisture inhibiting material by pre-impregnating the applicators and/or supplying the applicators with additional material from reservoirs in the carrier body 202, as compared to the embodiment described above with respect to FIG. 3A where a reservoir is formed in an internal volume between the carrier body 202 and the base 215, is that the entire perimeter of the interface between the base 215 and the carrier body 202 may not need to be sealed. As was described with respect to FIG. 3A, the entire perimeter can be sealed to maintain the reservoir formed by the carrier body 202 and the base 215. In the embodiment in FIG. 3B, the entire perimeter may not need to be sealed because the applicators themselves serve as a reservoir and/or the reservoir is located within the carrier body 202. Sealing the entire perimeter between the base 215 and the carrier body can affect the friction associated with the switch and the force required to actuate the switch. Thus, in some instances, it may be desirable to not extend the seal including the applicators 214 and 216 around the entire perimeter of the interface between the carrier body 202 and the base 215 to reduce the friction between these components.

Figure 4:
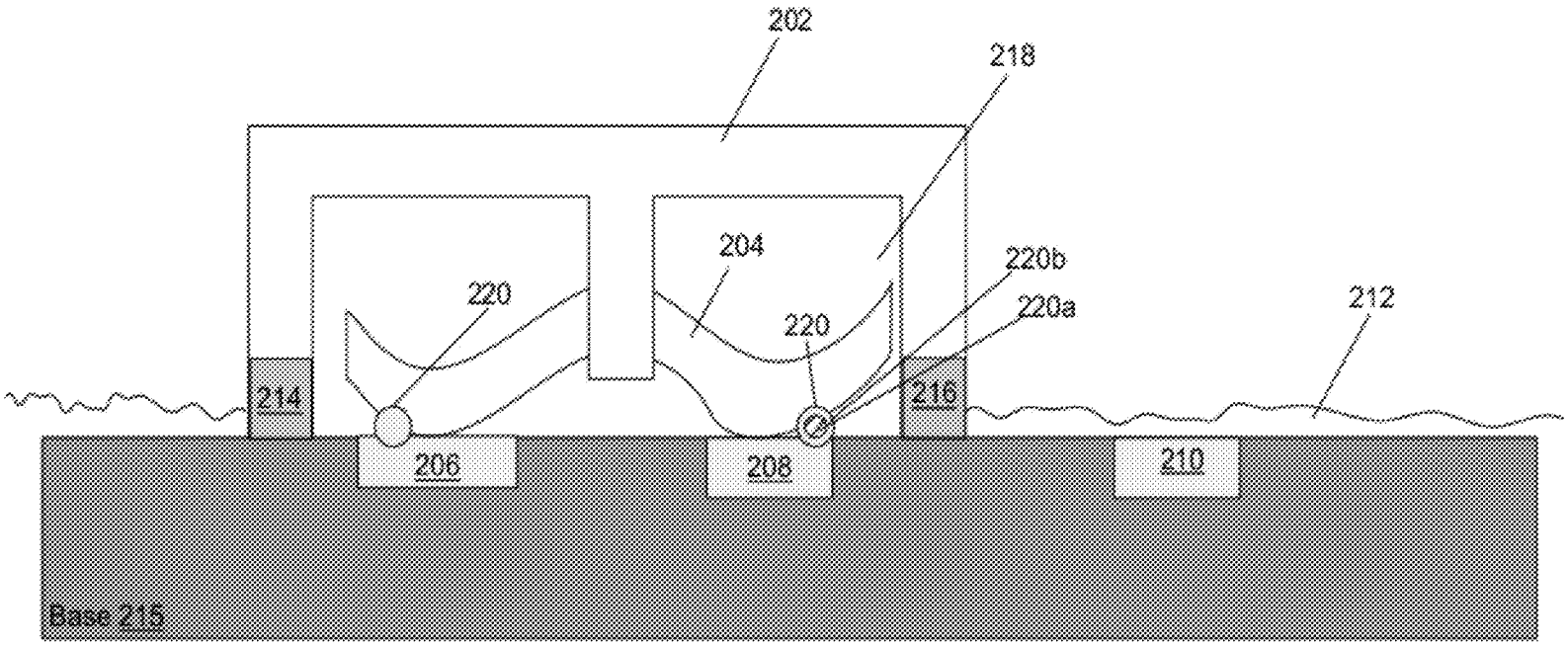
FIG. 4 is a cross sectional view of a slide switch assembly including a moisture-inhibiting material distribution mechanism coupled to a conductive portion of the switch in accordance with the described embodiments.

FIG. 4 shows another embodiment that can include features 220 that serve as applicators for the moisture inhibiting material 212. The features 200 can be attached to the bridging component 204. Features 220 can be used to retain an amount of lubricant that can then be used to replenish layer 212 as carrier 202 is moved over contacts 206, 208 and 210. In one embodiment, a reservoir 218, as described above with respect to FIG. 3A, can be formed between the carrier body 202 and the base 215 and the features 220 can absorb and/or spread the moisture inhibiting material stored in the reservoir 218 over the contact pads.

In another embodiment, the reservoir 218 may not be used. Instead, the features 220 can include an internal bladder 220*a* for storing the moisture inhibiting material 212. An interface between the bladder 220*a* and an outer portion 220*b* of the feature 220 can control a rate at which the moisture inhibiting material is dispensed into the outer portion 220*b*. In one embodiment, the contact pads can be slightly raised or a raised surface can be provided on the base (not shown). The raised surface can be configured such that when the features 220 pass over the raised surfaced the internal bladder 220*a* is squeezed forcing the moisture inhibiting material into the outer portion 220*b* of the feature 220. The moisture inhibiting material can then be dispensed onto the contact pads.

Figure 5A:
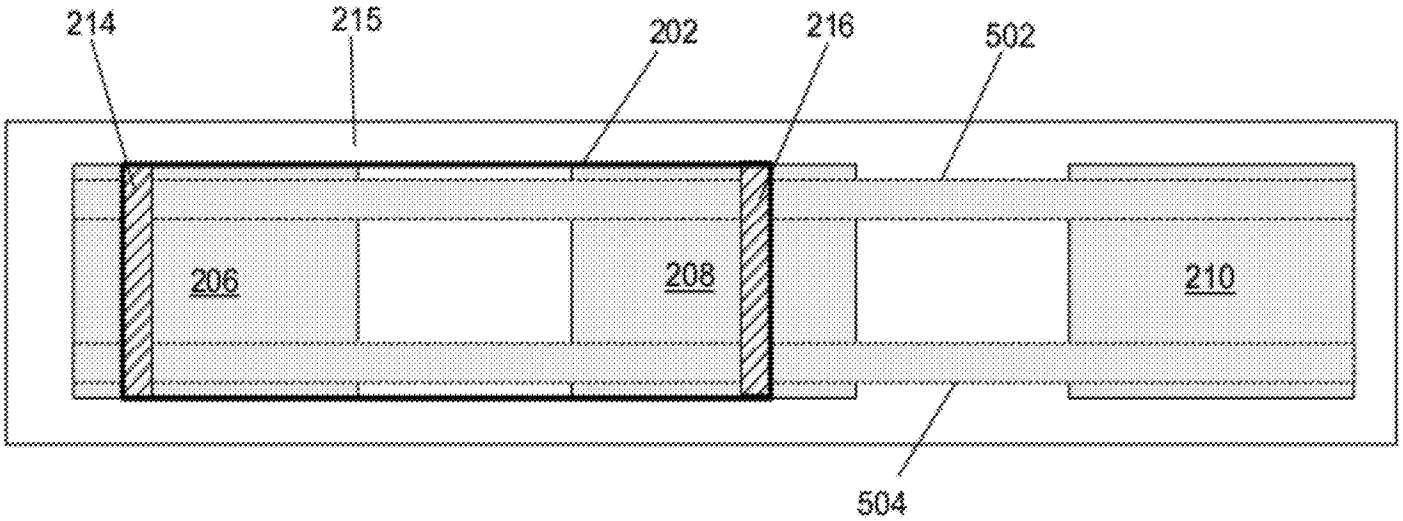
FIGS. 5A-B and 6 are top views of a slide switch assembly in different actuated positions in accordance with the described embodiments.

FIG. 5A shows a top down view of switch 100 showing contact tracks 502 and 504 consistent with moving carrier body 202. It should be noted that contact tracks 502 and 504 represent areas of most likely moisture intrusion since contact tracks 502 and 504 are those areas that come in direct physical contact with the bridging component coupled to the carrier body 202. Therefore, it can be important that the barrier layer (e.g., see layer 212 in FIG. 4) remain relatively intact in the area of contact tracks 502 and 504. In FIG. 5A, two contact tracks are shown. The width and number of contact tracks can vary and the example shown in FIG. 5A is provided for the purposes of illustration.

Figure 5B:
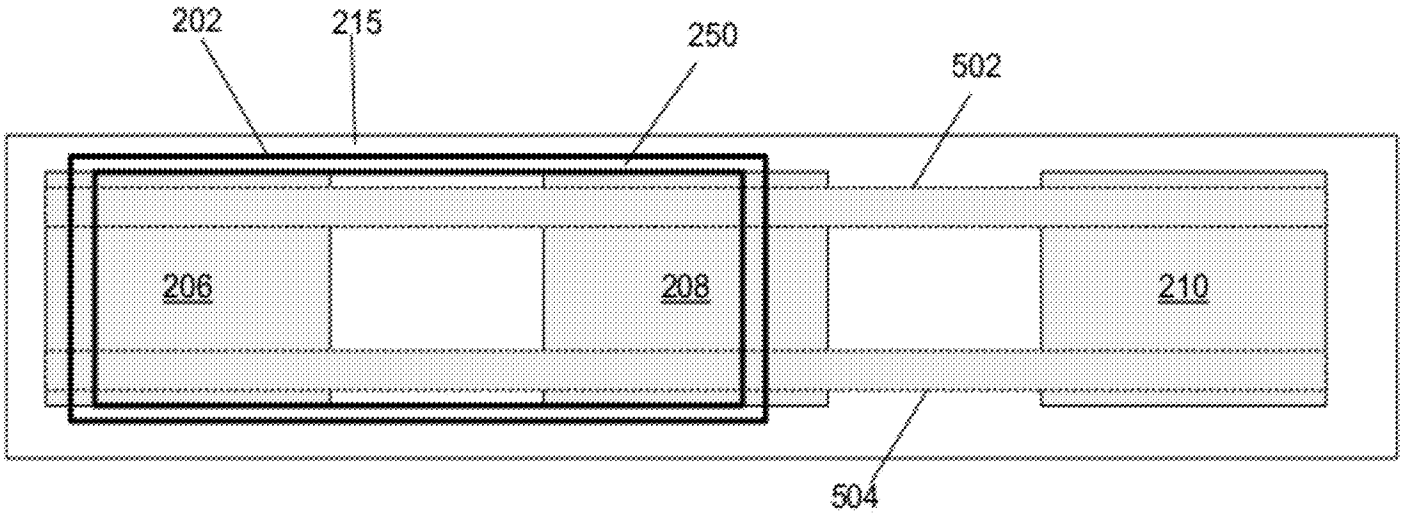

In FIG. 5A, applicators, 214 and 216 are shown at opposite ends of the carrier body 202 and a seal is not formed around the entire perimeter of the carrier body 202. In the embodiment described with respect to FIG. 3A, a reservoir is formed in an internal volume between the carrier body 202 and the base 214 and the material used to form the applicators 214 and 216 can extend around the perimeter of the carrier body 202. The additional material can help form a seal for containing the moisture inhibiting material in the reservoir. FIG. 5B shows an embodiment where the interface between the carrier body 202 and the base 215 includes a seal 250 around the perimeter of the carrier body 202. In this embodiment, portions of the seal 250 can serve as applicators for replenishing the moisture inhibiting material on the contact pads.

Figure 6:
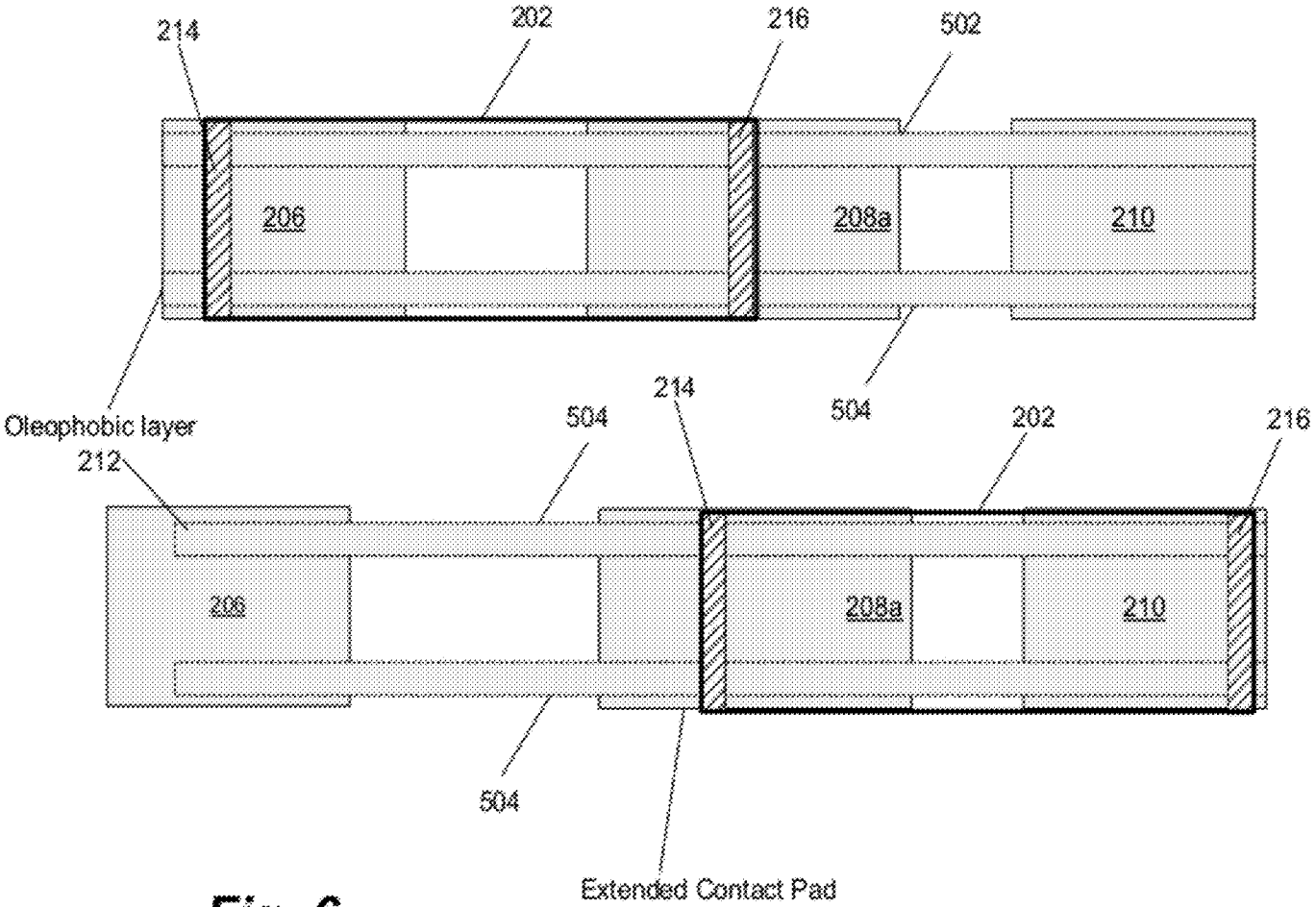

FIG. 6 shows an embodiment where contact pad 208 is larger in size than contact pads 206 and 210. The enlargement of contact pad 208 allows for carrier 202 to be in continuous contact with contact pad 208. During an actuation of the switch, a portion of the contact pad 208*a* is exposed depending on the position of the carrier body 202. The portion of the contact pad that is exposed can alternately be replenished with the moisture inhibiting material by applicator 214 or applicator 216. For instance, as the carrier body 202 is moved to the right from its left most position, the moisture inhibiting material is first replenished on contact pad via applicator 214 and then a left portion of the contact pad 208*a* is replenished with the moisture inhibiting material. Conversely, as the carrier body 202 is moved to the left from its right most position, the inhibiting material is first replenished on the contact 210 by applicator 216 and then a right portion of contact pad 208*a* is replenished with the moisture inhibiting material by applicator 216.

Figure 7A:
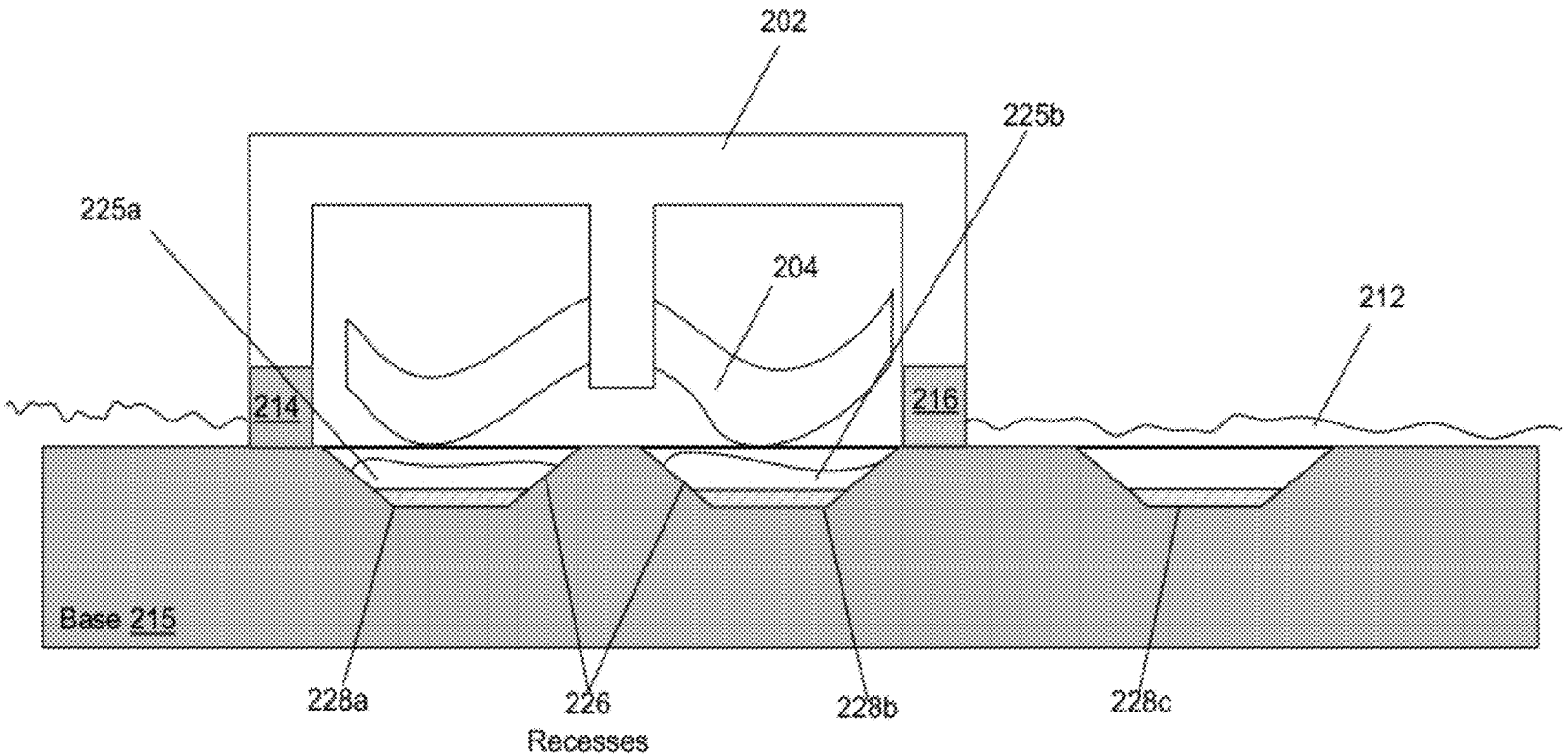
FIGS. 7A and 7B are cross sectional views of a slide switch assembly including lowered or raised contact pads in accordance with the described embodiments.

FIG. 7A shows cross section of contact pads 228*a*, 228*b*, and 228*c* where the contact pads are located at the bottom of recesses. In this way, when the switch is properly orientated, a small amount of lubricant can collect within the reservoir to provide a protective layer to the contact pad at the bottom of the recess. In one embodiment, chamfered edges can be used to reduce an amount of mechanical force that can be required for the bridging element 204, such as a spring arm, to pass over the recesses.

In this embodiment, the applicators 214 and 216 can be formed from a compressible material. The applicators can be installed such that they are compressed when resting on the base 215 portion outside of the recesses. Then, as the applicators move over the recesses, the applicators can expand to maintain contact and follow along the surface of the recess.

Figure 7B:
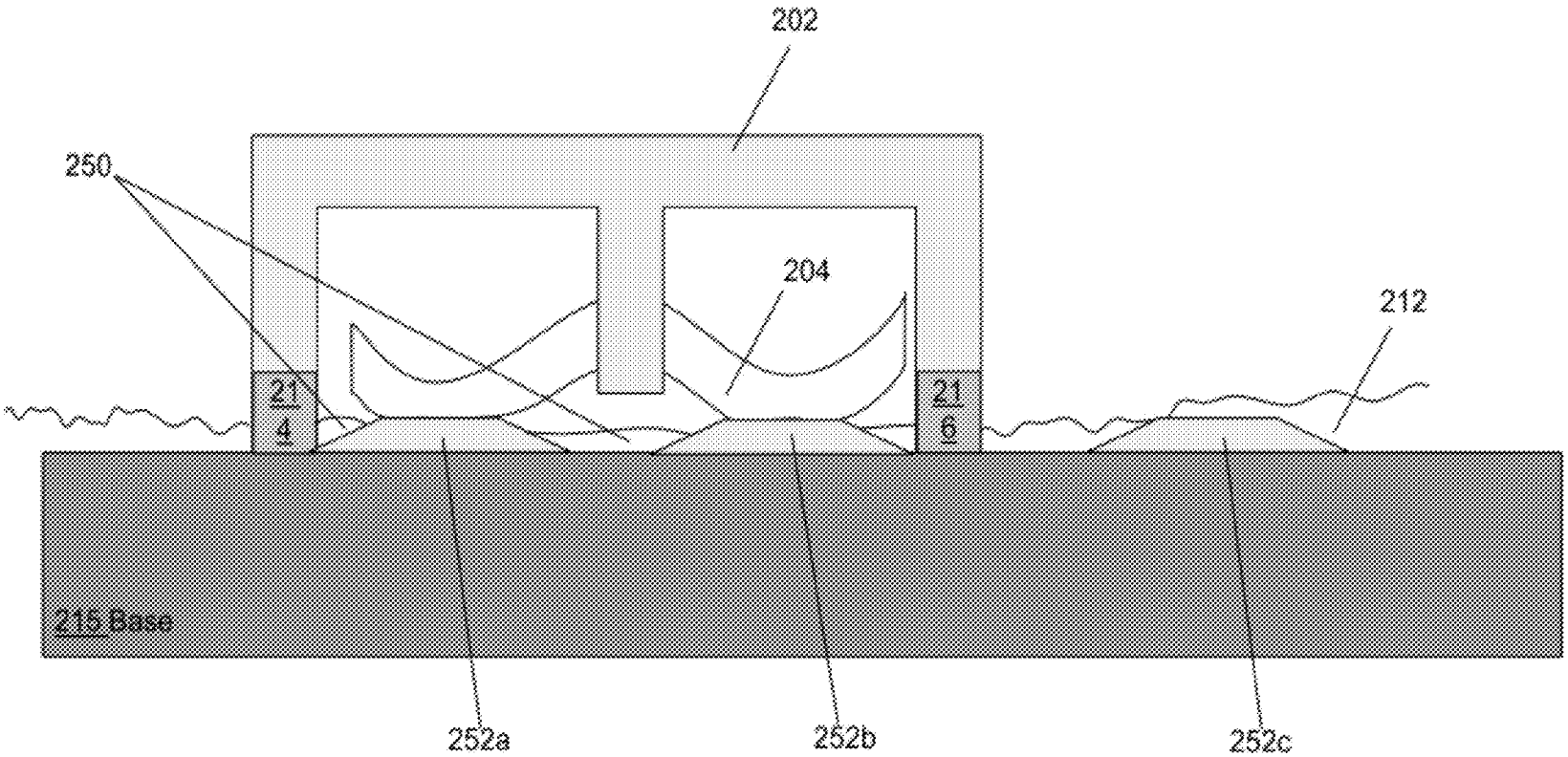

FIG. 7B shows cross section of contact pads 252*a*, 252*b*, and 252*c* where the contact pads are slightly raised. The contact pads can again be chamfered to reduce an amount of mechanical force that is required for the bridging element 204 to pass over the raised contact pads. In this embodiment, the moisture inhibiting material can collect in the spaces surrounding the contact pads. A portion of this material can be absorbed by the applicators 214 and 216. When the applicators pass over the raised contact pads, some amount of the moisture inhibiting material can be squeezed from the applicators as well as be removed from the applicators as a result of friction. The excess material can be applied to the contact pads to replenish the moisture inhibiting material on the contact pads.

Figure 8:
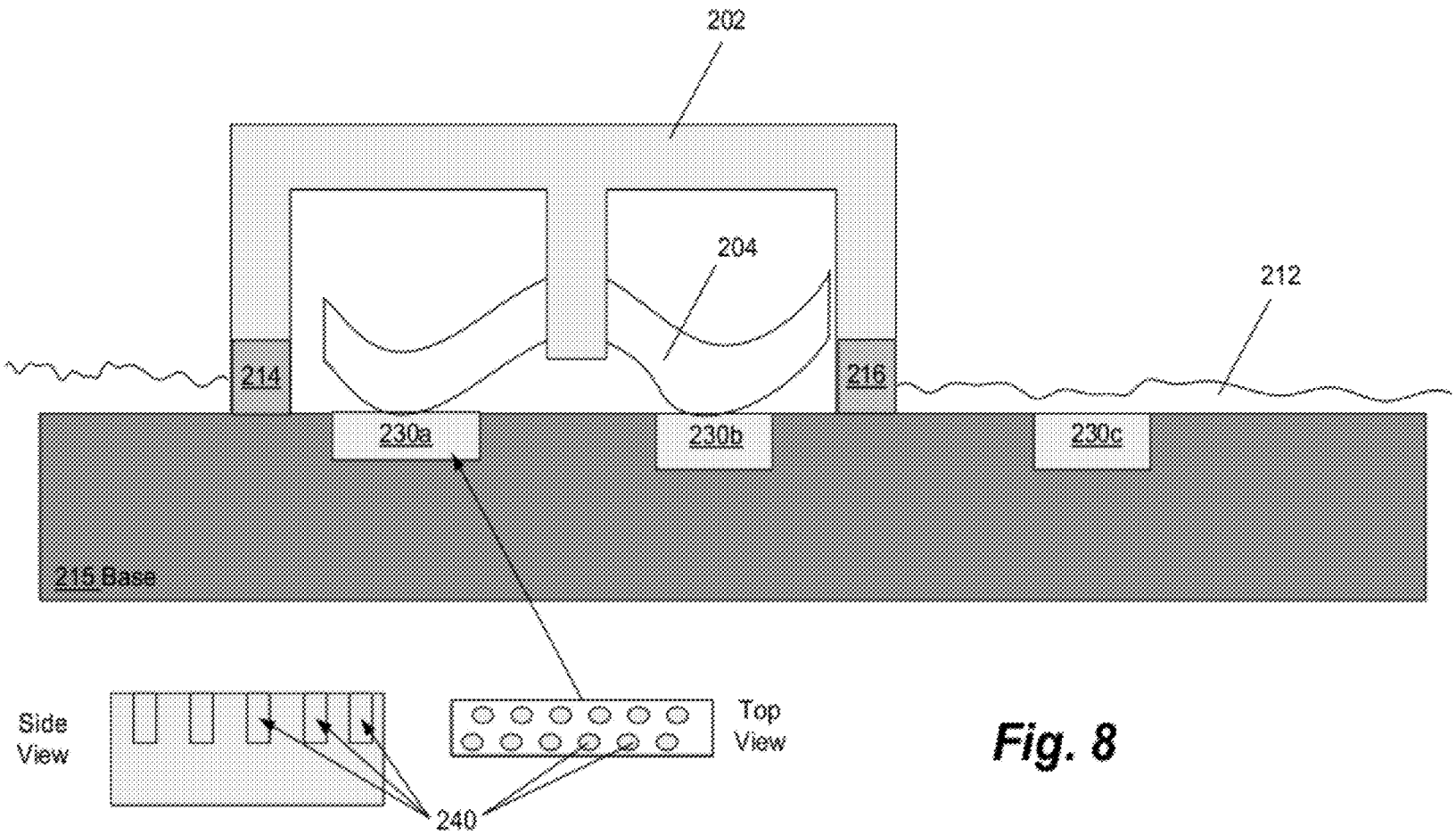
FIG. 8 is a cross sectional and a top view of a slide switch assembly including pitted contact pads in accordance with the described embodiments.

FIG. 8 shows a cross section of yet another embodiment whereby contact 230*a*, 230*b*, and 230*c* include a plurality of micropits 240 each of which can store a small amount of the moisture inhibiting material. The micropits 240 can be filled during manufacture of the contact pads and/or base 215. In this arrangement, when bridging component 204 and/or the applicators pass over the plurality of micropits in each contact pad, a siphon effect can pull at least some of the moisture inhibiting material out of at least some of micropits 240. The siphoned material can be used to replenish layer 212 in the process.

Figure 9A:
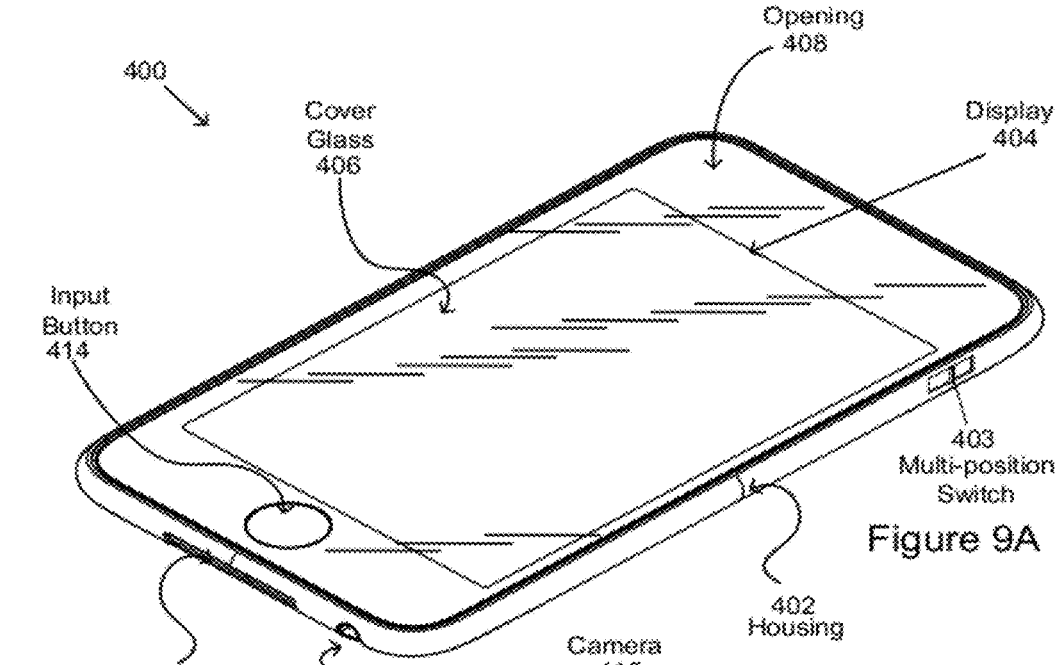
FIG. 9A shows a top view of a portable electronic device in accordance with the described embodiments.
Figure 9B:
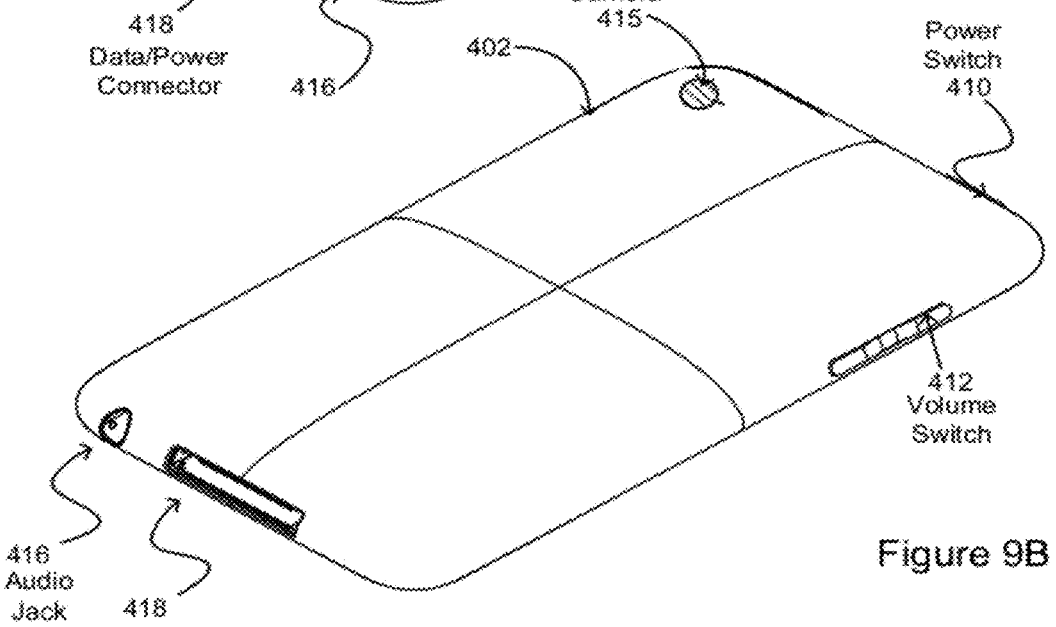
FIG. 9B shows a bottom view of a portable electronic device in accordance with the described embodiments.

FIGS. 9A and 9B show a top and bottom view of a portable computing device 400 in accordance with the described embodiments. The portable computing device can include one or more components formed using the thermoplastic and ceramic fiber material mixture described above. The portable computing device can be suitable for being held in the hand of a user. A cover glass 406 and a display 404 can be placed within an opening 408 of housing 402. The cover glass can include an opening for an input mechanism, such as input button 414. In one embodiment, the input button 414 can be used to return the portable computing device to a particular state, such as a home state.

Other input/output mechanisms can be arranged around a periphery of the housing 402. For instance, a power switch, such as 410 can be located on a top edge of the housing and a volume switch, such as 412, can be located along one edge of the housing. In addition, a multi-position slider switch 403 for generating control signals based upon a position of the switch can be located on a side opposite the volume switch 412. An audio jack 416 for connecting headphones or another audio device and a data/power connector interface 418 are located on the bottom edge of the housing. The housing 400 also includes an aperture for a camera 415 that allows video data to be received.

In different embodiments, the switches, such as the input button 414, the power switch 410, the volume switch 412 and the multi-position slider switch 403 can include a moisture inhibiting material distribution mechanism. The moisture inhibiting material distribution mechanism can be configured to replenish a moisture inhibiting material on internal surface components of the switch. The distribution mechanism can utilize a portion of the mechanical force that is input to actuate the switch to replenish the moisture inhibiting material on internal surfaces within the switch. For instance, for the input button 414, the distribution mechanism can utilize the downward force that is supplied to actuate the switch to replenish the moisture inhibiting material. Whereas, for the multi-position slider switch 403, the distribution mechanism can utilize the substantially parallel force that is supplied to actuate the switch 403 to replenish the moisture inhibiting material.

Figure 9C:
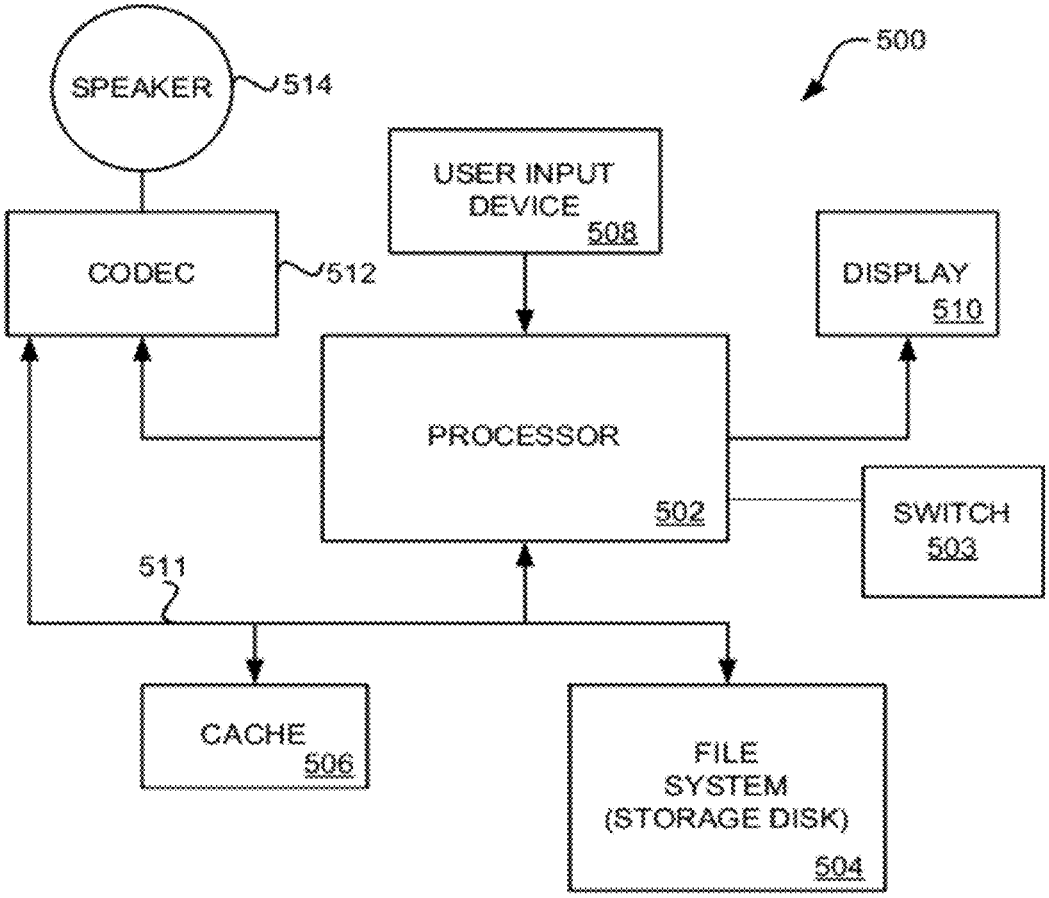
FIG. 9C is a block diagram of a media player in accordance with the described embodiments.

FIG. 9C is a block diagram of a media player 500 in accordance with the described embodiments. The media player 500 can include a processor 502 that pertains to a microprocessor or controller for controlling the overall operation of the media player 500. The processor 502 can receive control signals from various switches 503, such as the multi-position slider switch 403 described with respect to FIG. 9A. Based upon the received control signal, the processor 502 can operate the device 500 in accordance with the signal.

The media player 500 can store media data pertaining to media items in a file system 504 and a cache 506. The file system 504 can, typically, be a storage disk or a plurality of disks or a solid-state storage device, such as flash memory. The file system can provide high capacity storage capability for the media player 500. However, since the access time to the file system 504 can be relatively slow, the media player 500 also can include a cache 506. The cache 506 can be, for example, Random-Access Memory (RAM) provided by semiconductor memory. The relative access time to the cache 506 can be substantially shorter than for the file system 504. However, the cache 506 may not have the large storage capacity of the file system 504. Further, the file system 504, when active, can consume more power than does the cache 506. The power consumption can be particularly important when the media player 400 is a portable media player that is powered by a battery (not shown).

The media player 500 can also include a user input device 508 that allows a user of the media player 500 to interact with the media player 500. For example, the user input device 508 can take a variety of forms, such as a button, keypad, dial, etc. Still further, the media player 500 includes a display 510 (screen display) that can be controlled by the processor 502 to display information to the user. A data bus 511 can facilitate data transfer between at least the file system 504, the cache 506, the processor 502, and the CODEC 512.

In one embodiment, the media player 500 can store a plurality of media items (e.g., songs, video files and podcasts) in the file system 504. When a user desires to have the media player play a particular media item, a list of available media items is displayed on the display 510. Then, using the user input device 508, a user can select one of the available media items. The processor 502, upon receiving a selection of a particular media item, can supply the media data for the particular media item to a coder/decoder (CODEC) 512. The CODEC 512 can then produce analog output signals for a speaker 514. For a video based media item, a video CODEC can be utilized to output video images to the display 510. The speaker 514 can be a speaker internal to the media player 500 or external to the media player 500. For example, headphones or earphones that connect to the media player 500 would be considered an external speaker.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, DVDs, magnetic tape, flash memory and optical data storage devices. The computer readable medium can also be distributed over network-coupled computer systems so that the computer readable code is stored and executed in a distributed fashion.

Many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A switch, comprising:

an electrical circuit including:

a first conductive component;

a second conductive component wherein the first conductive component and the second conductive component are configured to move relative to one another in response to application of a mechanical input force wherein, during a range movement of the first conductive component and the second conductive relative to one another, the first conductive component and the second conductive component are brought into contact with one another, the contact effecting an electrical property associated with the electrical circuit; and a distribution mechanism for replenishing a moisture inhibiting material to the first conductive component or the second conductive component wherein the distribution mechanism is configured to replenish the moisture inhibiting material in response to the movement of the first conductive component and the second conductive component relative to one another.

2. The switch of claim 1, further comprising a reservoir for storing the moisture inhibiting material.

3. The switch of claim 1, wherein the distribution mechanism further comprises an applicator mechanism for applying the moisture inhibiting material to portions of the first conductive component or portions of the second conductive component.

4. The switch of claim 1, further comprising: a carrier body, the first conductive component coupled to the carrier body and a base including the second conductive component wherein the barrier body and the base are configured to move in a substantially parallel manner relative to one another.

5. The switch of claim 4, wherein second conductive component comprises a plurality of conductive contact pads separated by an insulating material and wherein the first conductive component comprises a conductive bridging component configured to contact different pairs of the plurality of conductive contact pads depending on a position of the carrier body relative to the base.

6. The switch of claim 5, wherein the conductive bridging component is a metal spring arm.

7. A slide switch, comprising:

a carrier body;

a bridging component attached to the carrier body;

a base, the base including a number of electrical contact pads, wherein a sliding force applied to the carrier body causes the bridging component to make electrical contact with no more than two of the electrical contact pads at a time; and a moisture inhibiting layer covering a top surface of each of the contact pads, wherein when the carrier body moves across the body of the slide switch, the moisture inhibiting layer over the contact pad that is not in contact with the bridging component is replenished thereby providing a moisture barrier for preventing moisture intrusion and resulting contact pad corrosion.

8. The switch of claim 7, wherein the bridging component is a metal spring arm.

9. The switch of claim 7, further comprising a reservoir for storing a moisture inhibiting material used to form the moisture inhibiting layer.

10. The switch of claim 9, wherein the reservoir is formed from portions of the carrier body and the base such that the moisture inhibiting material is partially contained in an interior volume surrounded by the carrier body and the moisture inhibiting material.

11. The switch of claim 7, wherein the electrical contact pads are placed in recesses within the base, the recesses for collecting or storing a moisture inhibiting material used to replenish the moisture barrier.

12. The switch of claim 7, further comprising: one or more applicators coupled to the carrier body for applying a moisture inhibiting material intended to replenish the moisture barrier on the electrical contact pads.

13. The switch of claim 12, wherein one or more applicators are pre-impregnated with the moisture inhibiting material for replenishing the moisture barrier.

14. A portable electronic device comprising:

a switch including:

a first conductive component;

a second conductive component wherein the first conductive component and the second conductive component are configured to move relative to one another in response to application of a mechanical input force wherein during a range movement of the first conductive component and the second conductive relative to one another, the first conductive component and the second conductive component are brought into contact with one another, the contact changing an electrical property of an output signal generated by the switch; and a distribution mechanism for replenishing a moisture inhibiting material to the first conductive component or the second conductive component wherein the distribution mechanism is configured to replenish the moisture inhibiting material in response to the movement of the first conductive component and the second conductive component relative to one another; and a processor and a memory configured to control operation of the portable electronic device in response to the output signal generated by the switch.

15. The portable electronic device of claim 14, wherein the switch further includes one or more reservoirs for storing the moisture inhibiting material.

16. The portable electronic device of claim 14, wherein the distribution mechanism includes one or more applicators, each applicator configured to coat a portion of the first conductive component or the second conductive component in response to an actuation of the switch.

17. The portable electronic device of claim 16, wherein one of the applicators is coupled to the first conductive component.

18. The portable electronic device of claim 14, wherein the switch is configured is a slider switch such that during actuation of the switch the first conductive component and the second conductive component move in a substantially parallel manner relative to one another.

19. A method of forming a slider switch comprising:

forming a carrier body including a bridging component in one or more applicators for applying a moisture inhibiting material;

forming a base including a plurality of contact pads;

attaching the carrier body to the base such that base and carrier body can move in a substantially parallel manner relative to one another and wherein the bridging component and the plurality of contact pads are arranged to allow the bridging component to touch no more than two of the plurality of contact pads at one time; and coating at least the plurality of contact pads with a moisture inhibiting material wherein, in response to the actuation of the slider switch, 1) friction between the bridging component and the metal contact pads removes the moisture inhibiting material and 2) the applicators replenish the moisture inhibiting material on at least portions of the metal contact pads where the moisture inhibiting material is removed as a result of the friction between the bridging component and the contact pads.

20. The method of claim 19, further comprising filling a reservoir with the moisture inhibiting material.

21. The method of claim 19, wherein moisture inhibiting material is an oleophobic material.

22. The method of claim 19, wherein the reservoir includes a plurality of small pits formed within the contact pads.

23. The method of claim 19, wherein the one or more applicators are formed from a material configured to absorb the moisture inhibiting material.

* * * * *